United States Patent [19]

Doherty

[11] 4,138,682

[45] Feb. 6, 1979

[54] CUBICAL QUAD ANTENNAS WITH SPREADER-REINFORCED CROSSARMS

[76] Inventor: R. Michael Doherty, 11 Hillcrest Dr., Avon, Conn. 06001

[21] Appl. No.: 762,145

[22] Filed: Jan. 24, 1977

[51] Int. Cl.[2] ..... H01Q 7/00; H01Q 1/16

[52] U.S. Cl. ..... 343/742; 343/819; 343/871

[58] Field of Search ..... 343/727, 742, 868, 871, 343/819

[56] References Cited

U.S. PATENT DOCUMENTS

| | | | |
|---|---|---|---|
| 3,284,801 | 11/1966 | Bryant | 343/742 |
| 3,373,434 | 3/1968 | Lorenzo | 343/879 |
| 3,532,315 | 10/1970 | Partridge | 343/742 |
| 3,553,701 | 1/1971 | Thomas | 343/814 |
| 3,821,742 | 6/1974 | Pollard | 343/727 |
| 4,021,811 | 5/1977 | Bastian | 343/742 |

FOREIGN PATENT DOCUMENTS

| | | | |
|---|---|---|---|
| 850974 | 10/1960 | United Kingdom | 343/742 |

*Primary Examiner*—Eli Lieberman

[57] ABSTRACT

This invention concerns itself with improvements to cubical quad antennas. The chief disadvantage to cubical quad antennas is their relative lack of strength and vulnerability to high winds and icing conditions. The present invention provides for a spreader reinforced crossarm system that adds appreciably to the strength of these antennas. There is also the added advantage that additional elements can be added and supported by the aforementioned guy line support system, thus alleviating the necessity for a crossarm assembly for each element. The one additional advantage of the invention is that elements can be supported by the ends of the spreaders themselves, thus affording a greater distance between elements than would be possible with just the boom and no spreaders with the effect of increasing the gain of the antenna array.

13 Claims, 3 Drawing Figures

CUBICAL QUAD ANTENNAS WITH SPREADER-REINFORCED CROSSARMS

Cubical quad antennas are known for their high forward gain as far as antenna arrays go. The added gain of these antennas as compared to, say, Yagi parisitic arrays of the same number of elements is due to the fact that the cubical quad elements are a full wavelength (or multiple wavelengths) as compared to the Yagi's half wavelength elements. The full wavelength elements of the cubical quad are shaped into the shape of a square with each side being one quarter wavelength in length. In a typical cubical quad array, two or more crossarms are attached to the boom of the antenna. These crossarms provide the necessary support to hold the element, typically made from copper wire, in the proper shape and position. In a two element array the two elements are typically separated from 0.1 to 0.14 wavelengths apart, and the separation is a function of the distance between the respective crossarms. The cubical quad is typically fed by a feedline composed of either coaxial cable or twinlead or open feeders whcih is inserted at the feedpoint of the driven element.

The chief disadvantage of cubical quad antennas thus described is that the complete structure is not particularly strong and is vulnerable to high winds and icing conditions. With high winds there is no countervailing support system in the typical cubical quad to resist the wind force upon the crossarms. Icing of the crossarms, wire elements, and boom add to and compound the problem by adding undesirable weight to the structure. There are many antenna failures as a result of this feature of cubical quad antennas under these conditions.

The present invention addresses this problem by providing for reinforcement of the crossarms. This is accomplished by the placing of spreaders on the crossarms and the use of guy lines to form a self supporting reinforcing system. In other words the crossarms are supported in all directions and thus will have greater strength to resist high winds and the additional weight caused by any ice formed on the antenna.

The spreaders and the associated guy line structure has the additional advantage of providing support for additional elements thus alleviating the necessity of having a crossarm for each element. Thus elements for several bands may be supported by the same crossarm-guy line system with the different appropriate spacing for each element possible without requiring a different crossarm for each element. Finall there is the additional advantage that elements can be supported by the crossarm spreaders themselves, thus increasing the effective boom length of the antenna without actually increasing the length of the boom. This would make it possible to further increase the gain of the antenna.

The advantages of the benefits of the antenna herein described will become more apparant when consideration is given to the numbered diagrams.

FIG. 1 is a perspective view of the antenna looking at the structure from above and from right of center. The structure is a two band antenna with a total of five (5) elements: two elements on the longer wavelength band, and three elements on the shorter wavelength band. In this case the bands are the Amateur Radio bands of 20 meters and 15 meters respectively, although this antenna design should be practible for most other bands, also.

Figure 1:
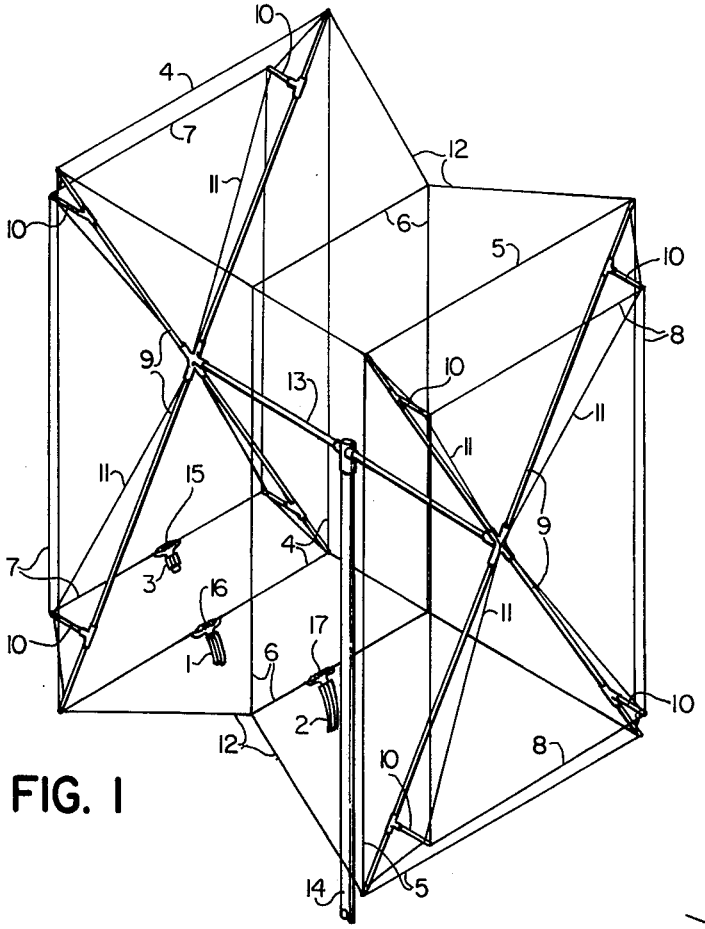
Figure 2:
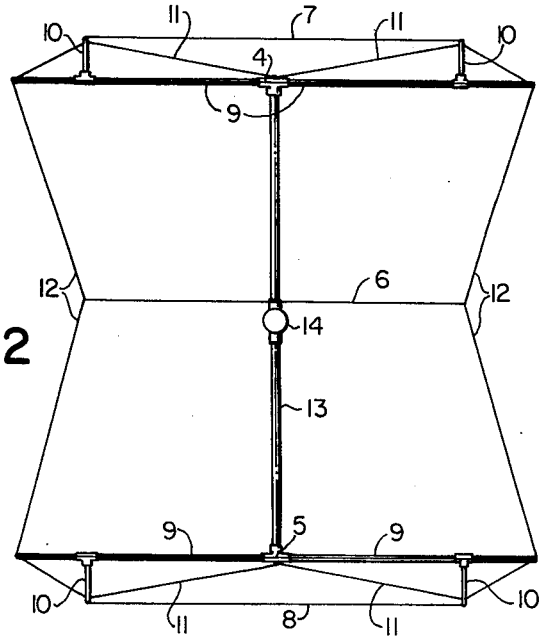
FIG. 2 is a top plan view of the cubical quad antenna.
Figure 3:
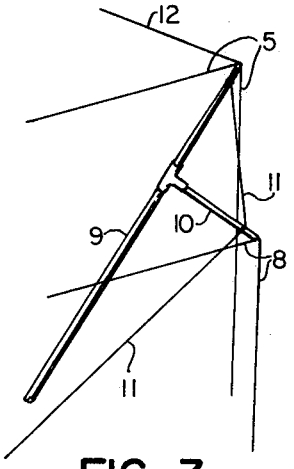
FIG. 3 is a fragmentary perspective view of one crossarm at its outer end including the spreader.

Referring to the numbered drawings, the improved cubical quad antenna that this invention provides includes a mast (14) supporting an antenna boom (13), at which ends are supported two pairs of crossarms (9). Stiffening and strengthening the structure are 8 crossarm spreaders (10) which in turn are supported and strengthened by the provision of element guylines (12) and spreader guylines (11). The mast (14) is constructed of steel or aluminum pipe and the boom (13) is constructed of aluminum tubing. The four crossarms are constructed out of either aluminum or fiberglass or other equally light weight strong substance. Likewise, the spreaders (10) are constructed out of a similar material as the crossarms (9).

The twenty meter driven element (4) is constructed out of copper or aluminum wire or some other metallic conducting material. It is supported in the shape of a square at the ends of the crossarms (9). Its length is approximately one wavelength (or multiple wavelengths) long and its exact length is adjusted until the element is resonant at the operating frequency. The element is fed on both side of an insulator (16) of nonferrous insulating material, such as glass or porcelain, by a feedline (11) of coaxial, twin lead, or other suitable transmission feedline. Gain from the antenna is obtsined by the use of a suitable director (5) spaced approximately 0.1 or slightly greater wavelength from the driven element (14). The director (5) is slightly less than a full wavelength long and its exact length is adjusted for either the greatest front-to-back ratio or for the greatest gain.

The fifteen meter driven element (6) is fed in a similar manner with an appropriate feedline (2) connected on both sides of an insulator (17). Besides the driven element (6), there is the addition of a reflector (7) element and a director (8) element. The reflector is approximately one wavelength in length and is adjusted in length for the greatest front to back ratio of the antenna by the adjustment of the tuning stub (3), which is attatched at one end to each side of the insulator (15) and which consists of a short piece of twin lead feedline or other comprable open wire feedline which is shorted together at the other end. The reflector element (7) is supported in the shape of a square by being supported by the ends of the crossarm spreaders (10). In a similar manner the fifteen meter director element (8) is supported by the ends of the corresponding crossarm spreaders (10). The length of the director element (8) is slightly less than a full wavelength and its length is adjusted for greatest gain of the antenna. The fifteen meter driven element (6) is supported in the shape of a square and is supported by the four element guy lines (12) which stretch from one crossarm to its respective crossarm at the other end of the boom (13). The guylines (12) are constructed of nylon, fiberglass, or other suitable material which is strong, lightweight, and nonmetallic. The ends of the spreader guylines (11) are attached to a metal or sturdy plastic ring which is attached to the end of the boom (13).

Now having thus described the antenna with reference to the numbered drawing, it is important to note that different construction techniques as well as different dimensions for different bands or combination of bands as deemed necessary for the particular application desired will not depart from the scope of the claims appended herein.

I claim:

1. A quad antenna comprised of: a support structure; a first pair of crossarms mounted to the support structure; a second pair of crossarms also mounted to the support structure in spaced relationship from the first pair with the tips of both pairs of arms in spaced array; a first antenna element extending between spaced points on the first pair of crossarms; a second antenna element extending between spaced points on the second pair of crossarms; spreaders mounted on the pairs of crossarms at positions between opposite ends of the crossarms and projecting in generally perpendicular relationship from the crossarms; a set of guy lines connected respectively to the crossarms on which the spreaders are mounted and extending from the respective spreaders to points on the arms spaced to each side of the spreaders; and another set of guy lines extending from the first pair of crossarms to the second pair of crossarms whereby the two sets of guy lines and the spreaders collectively cooperate to reinforece and strengthen the two pairs of crossarms.

2. A quad antenna as defined in claim 1 wherein at least four spreaders and associated guylines are mounted on the first pair of crossarms with the spreaders projecting into a plane generally parallel to the crossarms; and a third antenna element extends between the four spreaders in the plane parallel to the crossarms.

3. A quad antenna as defined in claim 2 wherein at least four spreaders and associated guylines are mounted on the second pair of crossarms, and the spreaders project into a plane generally parallel to the crossarms of the second pair; and a fourth antenna element extends between the spreaders on the second pair of crossarms in the plane parallel to the second pair.

4. A quad antenna as defined in claim 3 wherein a fifth antenna element is suspended on the other set of guylines extending between the corresponding crossarms.

5. A quad antenna as described in claim 1 wherein spreaders and corresponding guylines are mounted on each of the crossarms of the first and second pair.

6. A quad antenna as described in claim 5 wherein another antenna element is suspended from the other set of guylines extending between the first and second pair of crossarms.

7. A quad antenna as defined in claim 6 wherein still another antenna element is suspended from the spreaders on the first pair of crossarms in parallel relationship with the antenna element suspended from the other set of guylines between the first and second pair of crossarms.

8. A quad antenna in accordance with claim 1 wherein the first and second antenna elements are suspended in square patterns of generally the same size on the respective pairs of crossarms and in parallel relationship with each other.

9. A quad antenna comprised of: a boom; a first pair of intersecting crossarms mounted at their intersection to one end of the boom in a plane generally perpendicular to the boom; a first antenna element suspended in a generally square pattern from the projecting ends of the intersecting crossarms; a second pair of intersecting crossarms mounted at their intersection to the other end of the boom in a plane generally perpendicular to the boom and parallel to the plane of the first pair of crossarms; a second antenna element suspended in a generally square pattern from the second pair of intersecting crossarms in parallel relationship with the first antenna element; spreaders and associated guy lines connected with each of the crossarms of the first and second pairs for strengthening the individual crossarms, the spreaders on each arm projecting generally perpendicular to the arm at a point between the ends of the crossarm, and the associated guy line extending over the projecting end of the spreader and being fastened securely at each end to the crossarm at points spaced to each side of the speader, and additional guy lines extending between the first and second pairs of crossarms to establish mutual reinforcement of the two pairs in conjunction with the spreaders and associated guy lines.

10. A quad antenna as defined in claim 9 wherein two spreaders are connected to each crossarm and are located at opposite sides of the intersection of the crossarms, and the associated guylines extend from the intersection of the crossarms over the associated spreaders to the ends of the crossarms.

11. A quad antenna as defined in claim 10 wherein another antenna element is suspended in a generally square pattern from the spreaders on the first pair of crossarms and in parallel relationship with the first and second antenna elements.

12. A quad antenna as defined in claim 11 wherein still another antenna element is suspended in a generally square pattern from said additional guylines extending between the first and second pair of crossarms and in parallel relationship with the antenna element suspended from the spreaders on first pair of crossarms; and the first antenna element and the second antenna element suspended on the crossarms have a square pattern for one wavelength, and the other antenna elements suspended from the spreaders and guylines have a square pattern for a second wavelength.

13. A quad antenna as defined in claim 12 wherein said other antenna elements are suspended in planes in parallel relationship with each other and with the first and second elements and are separated by an amount different from the separation of the first and second antenna elements on the crossarms.

* * * * *